US009649668B1

(12) United States Patent
Delaney et al.

(10) Patent No.: US 9,649,668 B1
(45) Date of Patent: May 16, 2017

(54) ROTARY IMPINGEMENT CLEANING DEVICE WITH REPLACEABLE CARTRIDGE GEAR TRAIN

(71) Applicant: Alfa Laval Tank Equipment Inc., Exton, PA (US)

(72) Inventors: Robert E. Delaney, Kennett Square, PA (US); Andrew K. Delaney, West Chester, PA (US); John H. March, III, Coatesville, PA (US); Chad Morgan, Thorndale, PA (US); George E. Stewart, Ridley Park, PA (US)

(73) Assignee: Alfa Laval Tank Equipment, Inc., Exton, PA (US)

( * ) Notice: Subject to any disclaimer, the term of this patent is extended or adjusted under 35 U.S.C. 154(b) by 373 days.

(21) Appl. No.: 14/070,782

(22) Filed: Nov. 4, 2013

(51) Int. Cl.
*B08B 3/02* (2006.01)
*B05B 3/04* (2006.01)
*B08B 9/093* (2006.01)

(52) U.S. Cl.
CPC ..... *B08B 3/02* (2013.01); *B05B 3/0445* (2013.01); *B08B 9/0936* (2013.01); *B05B 3/0459* (2013.01)

(58) Field of Classification Search
CPC ..... B08B 9/0936; B08B 9/0813; B08B 9/093; B08B 3/02; B05B 13/0636; B05B 15/025; B05B 1/00; B05B 1/14; B05B 1/3046; B05B 3/023; B05B 3/025; B05B 3/026; B05B 3/027; B05B 3/028; B05B 3/06; B05B 3/066; B05B 3/1007; B05B 7/2494
USPC ..... 134/167 R, 22.18, 168 R; 239/225.1, 239/227, 237, 239, 240, 241, 242
See application file for complete search history.

(56) References Cited

U.S. PATENT DOCUMENTS

| | | | | |
|---|---|---|---|---|
| 3,326,468 | A | 6/1967 | Bristow et al. | |
| 5,640,983 | A * | 6/1997 | Sherman, Jr. | B05B 3/0445 134/167 R |
| 6,561,199 | B2 * | 5/2003 | Gleeson | B05B 3/0445 134/167 R |
| 2002/0028103 | A1 * | 3/2002 | Frank | A46B 11/063 401/197 |
| 2003/0015603 | A1 * | 1/2003 | Schreur | B08B 9/0936 239/227 |
| 2008/0314413 | A1 | 12/2008 | Wetzel et al. | |

FOREIGN PATENT DOCUMENTS

| | | |
|---|---|---|
| DE | 203 02 478 | 7/2003 |
| GB | 1 546 915 | 5/1979 |
| WO | WO 2006/000216 | 1/2006 |

* cited by examiner

*Primary Examiner* — Karla Moore
*Assistant Examiner* — Tinsae Ayalew
(74) *Attorney, Agent, or Firm* — Michael R. Philips

(57) ABSTRACT

The invention provides a rotary impingement cleaning apparatus including a gear train contained within a cartridge for easy installation and removal as a unit. The cleaning apparatus has an internal support platform to hold the cartridge and gear train. The platform is mounted within a fixed body housing. An output shaft from the cartridge gear train drives a rotary housing that drives a nozzle housing to rotate the nozzles around the horizontal axis.

11 Claims, 4 Drawing Sheets

ROTARY IMPINGEMENT CLEANING DEVICE WITH REPLACEABLE CARTRIDGE GEAR TRAIN

FIELD OF THE INVENTION

The present invention relates to the field of rotary impingement cleaning apparatus, and more particularly to a rotary impingement cleaning apparatus having a gear train contained in a cartridge that is replaceable as a unit.

BACKGROUND OF THE INVENTION

A rotary impingement cleaning apparatus generally operates by discharging a high pressure flow of a cleaning liquid through rotating nozzles to impinge and clean the inner wall of a container or vessel. The body of the cleaning apparatus is rotated around a first axis while the nozzles rotate around a second axis, the second axis being oriented angularly to the first axis, often in perpendicular relation. Depending on the particular container or vessel and the stored materials therein, the cleaning liquid will be drained or recycled through filtration apparatus.

With high pressure liquid flowing through the cleaning apparatus, the liquid also strongly impacts internal parts of the apparatus causing the initial parts impacted by the liquid to be driven at a high speed. To reduce the speed to a degree that allows the cleaning apparatus to perform a thorough cleaning of the interior vessel walls, the speed is reduced, typically by internal gearing. The gears are therefore subjected to substantial stress and will, over time, wear and malfunction. Ultimately, replacement of gears and related parts, e.g. bearings, is required.

The process of replacing gears and related parts in this fairly intricate apparatus involves time and skill. Often, the user of the rotary impingement cleaning apparatus will entrust the part replacement function to the apparatus manufacturer, placing the apparatus out of service for an extended period of time. It is therefore understood that there is a need for a rotary impingement cleaning apparatus having parts that are subject to wear, e.g. a gear train, that may be readily replaced on site to allow the apparatus to be quickly returned to service.

SUMMARY OF THE INVENTION

A rotary impingement cleaning apparatus having a unitary and readily replaceable gear train enclosed in a cartridge is provided by the present invention. The gear train includes multiple stages of planetary gear clusters with input and output shafts connected thereto. The gear clusters are each formed with identical spur gears, each cluster being equal to the others. In the described embodiment, three gear clusters are employed. The cartridge is surrounded by a channel for a flow of pressurized cleaning liquid to travel from an inlet port to a set of rotating nozzles. The cartridge has an array of holes near the input end and a second array of holes near the output end to enable a portion of the pressurized cleaning liquid to enter the cartridge and provide lubrication to the gears.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
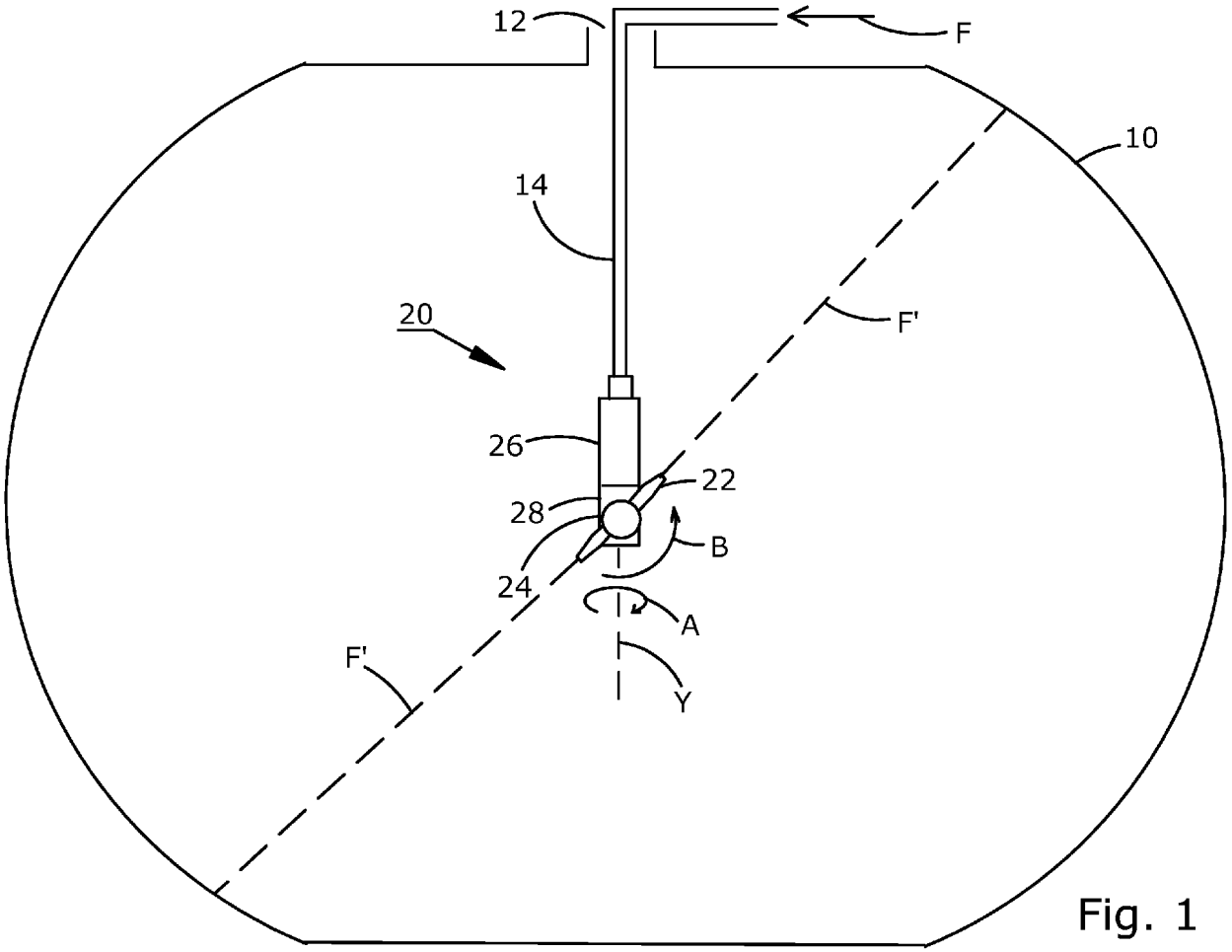
FIG. 1 is a schematic front elevation view of a rotary impingement cleaning apparatus of the invention mounted for cleaning the interior wall of a storage vessel.

Referring to FIG. 1, a storage vessel 10 is shown in schematic front elevation view with a rotary impingement cleaning apparatus 20 suspended therein. An inlet pipe 14 passes into vessel 10 through access port 12 and suspends cleaning apparatus 20 in the approximate center of vessel 10. Inlet pipe 14 also serves to supply a flow of pressurized cleaning liquid F to cleaning apparatus 20. Flow F of pressurized cleaning liquid travels through a stationery body housing 26 of cleaning apparatus 20, while driving rotary housing 28 to rotate around the Y axis in the direction indicated by arrow A. Internal gearing in rotary housing 28 causes nozzles 22 to simultaneously rotate about the X axis (not shown) in the direction indicated by arrow B, discharging opposed outlet flows F' of cleaning liquid to impinge the interior wall of vessel 10, effectively cleaning the interior vessel wall. The residual cleaning liquid at the bottom of vessel 10 may be removed by gravity drain or by suction depending on the situation.

Figure 2:
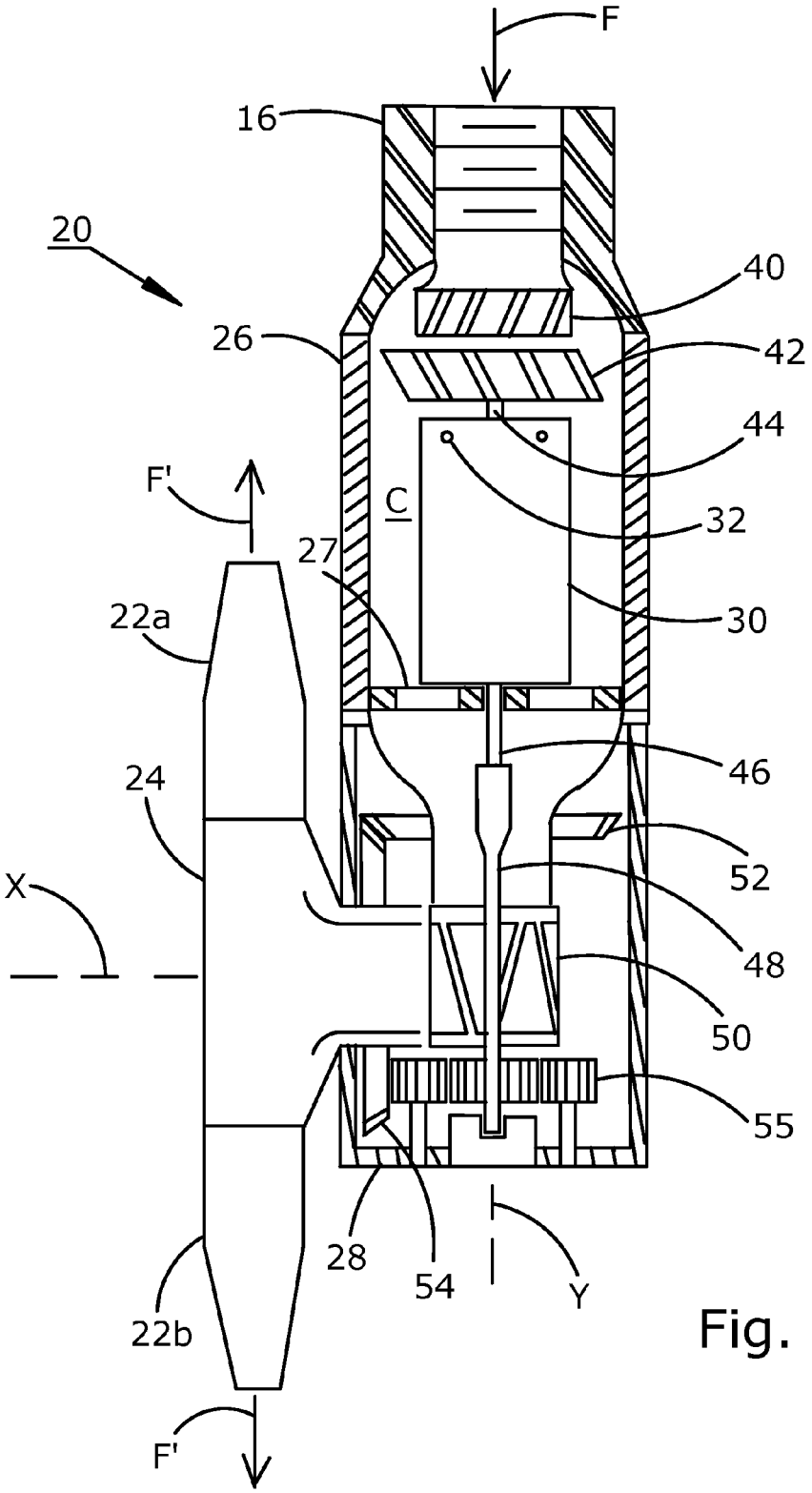
FIG. 2 is a side elevation view of the rotary impingement cleaning apparatus of the invention shown in partial cross section.

Referring now to FIG. 2, the rotary impingement cleaning apparatus 20 of the invention is shown in side elevation view with external parts depicted in cross section. Connective components and sealing components are not shown for reasons of clarity. An inlet cap 16 is mounted to a body housing 26, neither inlet cap 16 nor body housing 26 rotate during operation of the rotary impingement cleaning apparatus. Inlet cap 16 is shown with internal pipe threads as an efficient means for connecting an inlet pipe (see part 14 in FIG. 1) for supplying cleaning liquid F. Adjacent to the lower end of the pipe thread, a stator 40 is fixedly mounted. Stator 40 is formed as a round block with a series of angularly disposed slots passing from top to bottom. The angular slots serve to divert cleaning liquid F passing through stator 40 from vertical orientation in line with axis Y to an orientation angular thereto. Adjacent to the bottom of stator 40 is a rotor 42 having a radial array of vanes formed therein, the vanes being angled to be impinged by pressurized liquid exiting from stator 40, thereby causing rotor 42 to rotate around the Y axis. Rotor 42 is removably connected to drive an input shaft 44 that is connected to drive a set of gears within an enclosed cylindrical container designated cartridge 30. Cartridge 30 is formed with an array of inlet holes 32 around the periphery of and adjacent to the upper extremity of cartridge 30. In the preferred embodiment of the invention, there are four holes 32 positioned at uniform angular dispersal around cartridge 30. A flow channel C remains open in the area between the exterior of cartridge 30 and the interior of body housing 26. As pressurized cleaning liquid F flows through inlet cap 16, through stator 40 and past rotor 42, the major volume of liquid passes through channel C. Due to the pressure, a small portion of the cleaning liquid enters and passes through holes 32 into the interior of cartridge 30 for the purpose of lubricating the gears therewithin. Further detail of the structure within cartridge 30 will be described below. Cartridge 30 is supported on a platform 27 that is fixedly mounted within body housing 26 in a manner to readily install and subsequently remove cartridge 30 as a single unit with ordinary tools in an efficient time. Platform 27 is formed with a central hole to receive output shaft 46 in a bearing (not shown). Platform 27 has an array of openings formed therethrough to enable the cleaning liquid passing through channel C to enter rotary housing 28 and flow through stem 50, as well as to provide passage for the minor portion of the liquid flow exiting from cartridge 30.

Referring further to FIG. 2, an output shaft 46 extends from the lower end of cartridge 30. Output shaft 46 removably interlocks with a drive shaft 48 that functions to drive rotary housing 28 by means of a set of gears 55, causing rotary housing 28 to rotate around axis Y. A drive bevel gear 52 is affixed within rotary housing 28 to rotate therewith, drive bevel gear 52 being engaged with a driven bevel gear 54 causing driven bevel gear 54 to rotate around axis X. Driven bevel gear 54 is fixedly mounted to a nozzle housing 24 that is caused to rotate around axis X. A plurality of nozzles 22*a*, 22*b* are mounted to nozzle housing 24 to rotate therewith. In the preferred embodiment of the invention, there are two nozzles 22*a*, 22*b*, although different numbers of nozzles are similarly appropriate to the purpose of the present invention. The number of teeth formed on drive bevel gear 52 differs by a small amount from the number of teeth formed on driven bevel gear 54, e.g. by 1-3 teeth, to cause the full rotational cycle of rotary housing 28 to be different from the rotational cycle of nozzle housing 24, thereby ensuring that the streams of pressurized cleaning liquid discharged from nozzles 22*a*, 22*b* will impinge all areas of the vessel being cleaned. The cleaning liquid continues through channel C to pass into a fixedly mounted stem 50. Stem 50 is formed as a cylindrical grid with an open top end and passages through the walls that are peripherally dispersed to enable liquid to flow to nozzle housing 24 as rotary housing 28 and nozzle housing 24 rotate around axis Y.

Figure 3:
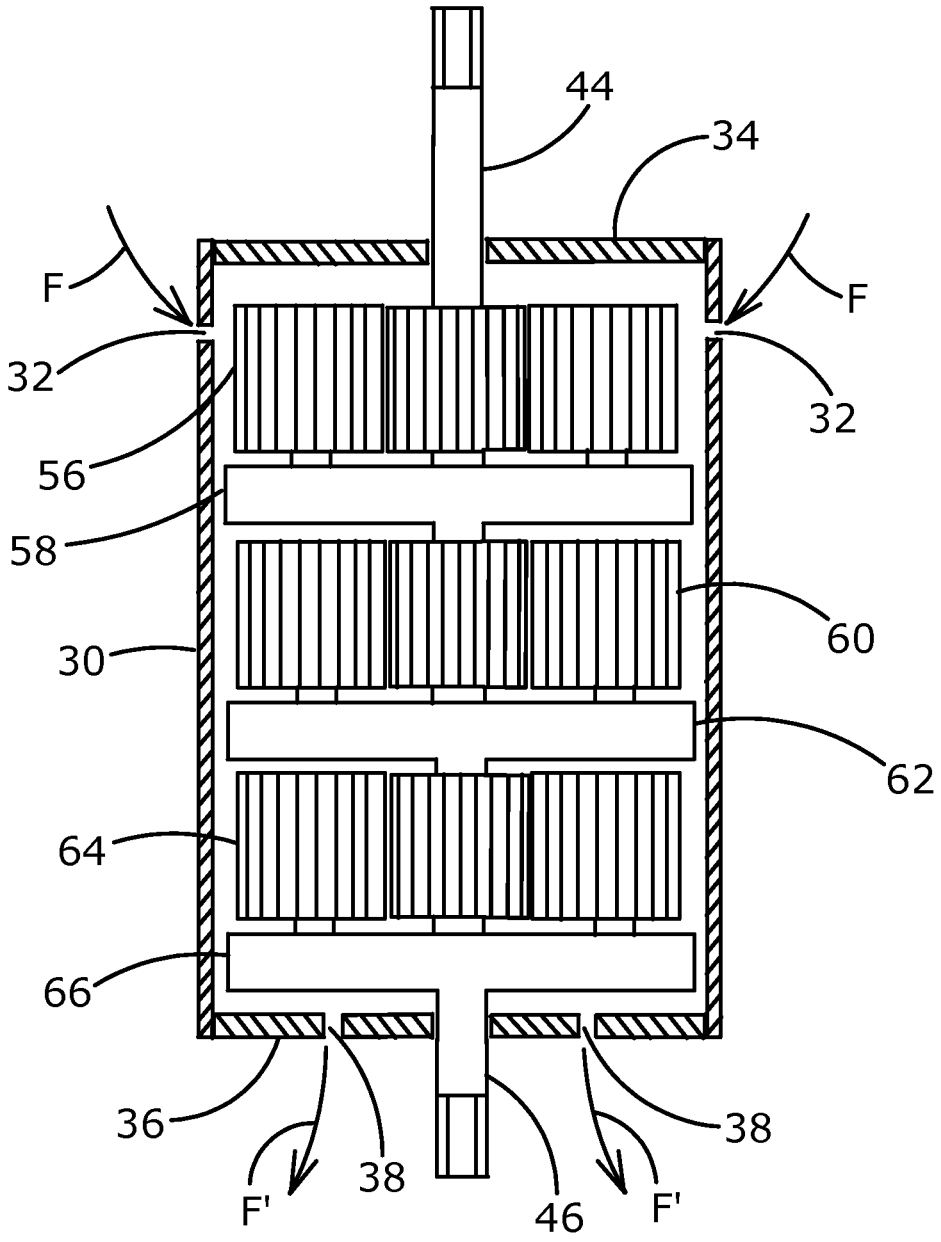
FIG. 3 is a cross sectional view of a cartridge gear train of the invention.

Referring now to FIG. 3, the gear train and cartridge housing of the invention are shown in side elevation view with external parts shown in cross section. Cartridge 30 is formed as a round cylinder with open top and bottom ends. The top end of cartridge 30 is provided with a top closure 34, and the bottom end of cartridge 30 is provided with a bottom closure 36, top closure 34 and bottom closure 36 being affixed in cartridge 30 with internal snap rings (not shown). A plurality of inlet holes 32 are formed through an upper portion of the wall of cartridge 30. Bottom closure 36 is formed with a plurality of outlet holes 38. In operation, a portion of the pressurized cleaning liquid entering through inlet cap 16 (see FIG. 2) flows into cartridge 30 through inlet holes 32 and flows out through outlet holes 38 in bottom closure 36 to provide lubrication to the internal gears. Input shaft 44 is engaged to drive a first planetary gear stage 56. In the gear train being disclosed, each of the three planetary gear stages is formed with three spur gears that are separated by 120° when viewed from above, with each spur gear being equal to the other two spur gears. The three spur gears of first stage 56 are rotatably mounted on a set of pins attached to a first stage platform 58. A central pin extends downward from first stage platform 58 to engage and drive a second planetary gear stage 60. Second planetary gear stage 60 is mounted on a second stage platform 62 and is formed substantially identically with first gear stage 56 and first stage platform 58. Second stage platform 62 similarly has a downwardly extending pin to engage and drive a third planetary gear stage 64 and third stage platform 66. Input shaft 44, first stage platform 58 and second stage platform 62 each terminate at their respective lower ends in a spur gear configuration. Third stage platform 66 has a pin 46 extending downward therefrom and formed with a terminal configuration, e.g. a hexagonal tip, for engaging downstream components to be driven thereby.

As described above, the cartridge and gear train of the invention is readily removable from the body of the rotary impingement cleaning apparatus, to be replaced with a new similar unit. Furthermore, configuring the gear train with spur gears that are all equal and interchangeable enables simple spare parts inventory and efficient unit rebuilding.

Figure 4:
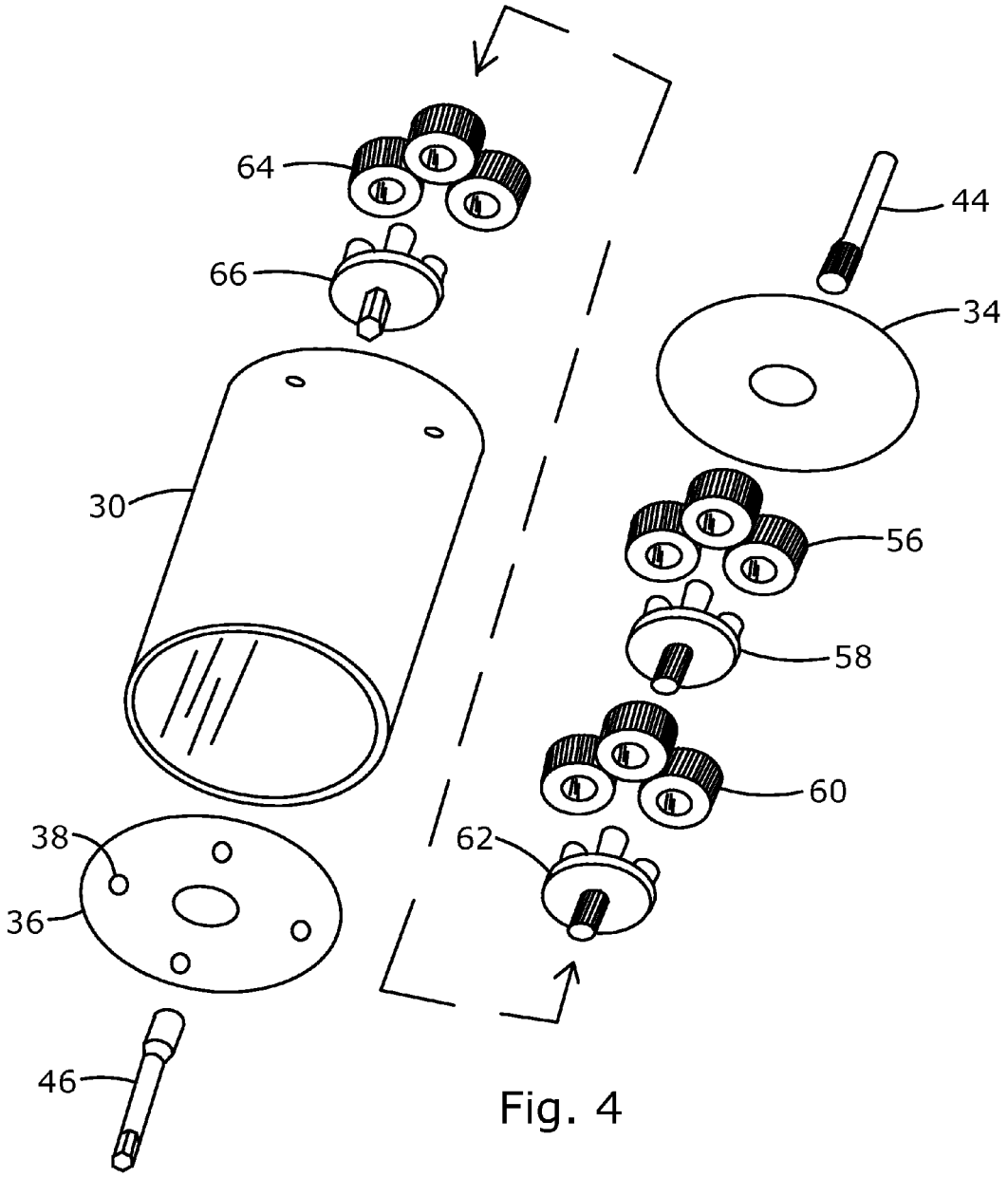
FIG. 4 is an exploded perspective view of the cartridge gear train of FIG. 3.

Referring now to FIG. 4, the cartridge and gear train of the invention are illustrated in exploded perspective view. For assembly, first planetary gear stage 56 is mounted on three uniformly dispersed pins extending upward from first stage platform 58. A pin extending downward from first stage platform 58 is formed as a further spur gear for engaging each of the three gears of second planetary gear stage 60 as they are assembled on pins extending upward from second stage platform 62. A pin extending downward from second platform 62 is formed as a further spur gear for engaging each of the three gears of third planetary gear stage 64 as they are assembled on pins extending upward from third stage platform 66. The pin extending downward from third stage platform 66 is formed with a non-round end, e.g. a hexagonal end, for engaging output shaft 46 that passes through the center opening in bottom closure 36. Bottom closure 36 is formed with a plurality of drain holes 38. The upper end of output shaft 46 is formed with a matching cavity, e.g. hexagonal, to receive the pin extending downward from third stage platform 66. At this point, the assembly of three planetary gear stages 56, 60, 64 and intermediate platforms 58, 62, 66 with bottom closure 36 and output shaft 46 are positioned in cartridge 30. Top closure 34 with input shaft 44 are then assembled with the bottom end of input shaft 44, formed with an integral spur gear engaging first planetary gear stage 56. As noted above, fasteners, seals, bearings, etc. are not illustrated to retain focus on the unique design features of the invention.

While the description above discloses a preferred embodiment of the present invention, it is contemplated that numerous variations and modifications of the invention are possible and are considered to be within the scope of the claims that follow.

What is claimed is:

1. A rotary impingement cleaning apparatus, comprising:

a. an inlet cap for receiving a flow of pressurized cleaning liquid;

b. a body housing connected to the inlet cap for receiving the flow of pressurized cleaning liquid from the inlet cap;

c. a rotor assembled within the body housing for receiving and being rotated by the flow of pressurized cleaning liquid;

d. a platform formed with a plurality of openings therethrough, the platform being fixedly mounted within the body housing;

e. a cartridge formed with a set of inlet holes and a set of outlet holes and having a gear train assembled therewithin, the gear train connected to and driven by the rotor, the cartridge being supported on the platform;

f. a rotary housing rotatably mounted to the body housing and rotated by the gear train;

g. a nozzle housing rotatably mounted to the rotary housing, the nozzle housing rotated by the rotary housing;

h. a plurality of nozzles affixed to the nozzle housing for receiving and discharging the flow of pressurized cleaning liquid to impinge and clean an interior surface of a storage vessel; and i. a channel for conducting a first portion of the flow of pressurized cleaning liquid from the rotor, around the cartridge, through the rotary housing and through the nozzle housing to be discharged through the plurality of nozzles, a second portion of the flow of pressurized cleaning liquid passing through the cartridge via the inlet holes and the outlet holes;

j. wherein the cartridge is replaceably mounted within the body housing in a manner to enable installation and removal of the cartridge and gear train as a unit.

2. The rotary impingement cleaning apparatus described in claim 1, wherein the rotary housing is rotatable around a first axis and the nozzle housing is rotatable around a second axis.

3. The rotary impingement cleaning apparatus described in claim 2, wherein the first axis is substantially parallel to an axis of the cartridge.

4. The rotary impingement cleaning apparatus described in claim 2, wherein the second axis is oriented substantially perpendicular to the first axis.

5. The rotary impingement cleaning apparatus described in claim 1, wherein the gear train is formed with multiple stages of gears.

6. The rotary impingement cleaning apparatus described in claim 5, wherein the gears are configured as planetary gear sets.

7. The rotary impingement cleaning apparatus described in claim 6, wherein individual spur gears in each planetary gear set are equal to each other.

8. The rotary impingement cleaning apparatus described in claim 7, wherein each of the multiple gear sets are equal to each other.

9. The rotary impingement cleaning apparatus described in claim 1, wherein the set of inlet holes comprises 4 inlet holes and the set of outlet holes comprises 4 outlet holes.

10. The rotary impingement cleaning apparatus described in claim 1, wherein the plurality of nozzles comprises 2 nozzles disposed in opposed orientation.

11. The rotary impingement cleaning apparatus described in claim 1, wherein the nozzle housing rotates at a speed that is different from the speed of rotation of the rotary housing.

* * * * *